US008352082B2

(12) United States Patent
Parker et al.

(10) Patent No.: US 8,352,082 B2
(45) Date of Patent: Jan. 8, 2013

(54) METHODS AND APPARATUSES FOR DISPLAYING ENERGY SAVINGS FROM AN HVAC SYSTEM

(75) Inventors: Kevin L. Parker, Raleigh, NC (US); Alexander Filippenko, Cary, NC (US)

(73) Assignee: Schneider Electric USA, Inc., Palatine, IL (US)

( * ) Notice: Subject to any disclaimer, the term of this patent is extended or adjusted under 35 U.S.C. 154(b) by 407 days.

(21) Appl. No.: 12/651,119

(22) Filed: Dec. 31, 2009

(65) Prior Publication Data

US 2011/0160913 A1 Jun. 30, 2011

(51) Int. Cl.
*G05D 23/00* (2006.01)

(52) U.S. Cl. ..... 700/276

(58) Field of Classification Search ..... 700/276; 165/200–303

See application file for complete search history.

(56) References Cited

U.S. PATENT DOCUMENTS

| | | | | |
|---|---|---|---|---|
| 2,789,201 | A | 4/1957 | Sherwin | |
| 3,233,176 | A | 2/1966 | Iben | |
| 3,998,093 | A | 12/1976 | Bertolasi | |
| 4,120,031 | A | 10/1978 | Kincheloe | |
| 4,252,151 | A | 2/1981 | Haung et al. | |
| 4,373,351 | A | 2/1983 | Stamp, Jr. et al. | |
| 4,644,320 | A | 2/1987 | Carr et al. | |
| 4,685,615 | A | 8/1987 | Hart | |
| 6,167,389 | A | 12/2000 | Davis et al. | |
| 6,478,233 | B1 * | 11/2002 | Shah | 236/46 R |
| 6,622,097 | B2 | 9/2003 | Hunter | |
| 6,956,500 | B1 | 10/2005 | Ducharme et al. | |
| 7,360,717 | B2 * | 4/2008 | Shah | 236/46 R |
| 2006/0065750 | A1 * | 3/2006 | Fairless | 236/46 R |
| 2006/0131434 | A1 | 6/2006 | Butler | |
| 2008/0083834 | A1 * | 4/2008 | Krebs et al. | 237/2 A |
| 2010/0082174 | A1 * | 4/2010 | Weaver | 700/295 |
| 2011/0153090 | A1 * | 6/2011 | Besore et al. | 700/278 |

FOREIGN PATENT DOCUMENTS

DE 100 57 834 A1 6/2002

OTHER PUBLICATIONS

User's Guide entitled, "RC-1000 and RC-2000 Programmable Communicating Thermostat," 20 pages (Mar. 2008).
Armstrong M: "Thermostat Setbacks—Do They Really Work?", www.homeenergy.org, Internet Article, Dec. 2008 http://www.homeenergy.org/article_full.php?id=566.
Article 94(3) EPC Communication, dated Mar. 22, 2012. 8 pages.
European Search Report, Dated May 16, 2011. 8 pages.

* cited by examiner

*Primary Examiner* — Mohammad Ali
*Assistant Examiner* — Sivalingam Sivanesan
(74) *Attorney, Agent, or Firm* — Nixon Peabody LLP

(57) ABSTRACT

A method and system of determining and displaying energy savings from an HVAC system operating in an energy saving mode. The HVAC system is operated to maintain a comfort mode temperature during a learning period. The energy consumed by the HVAC system at multiple outside ambient conditions during the learning period is determined. The correlation between a specific ambient condition and energy consumed by the HVAC system is determined. The HVAC system is run to maintain an energy saving setpoint temperature. The energy consumed by the HVAC system is determined at an ambient condition while maintaining the energy saving setpoint temperature. The energy savings are calculated as a function of the difference between the energy that would have been consumed by the HVAC system at the ambient condition based on the determined correlation and the energy consumed by the HVAC system while maintaining the energy saving setpoint temperature at the ambient condition.

21 Claims, 6 Drawing Sheets

METHODS AND APPARATUSES FOR DISPLAYING ENERGY SAVINGS FROM AN HVAC SYSTEM

FIELD OF THE INVENTION

The present invention relates generally to the determination of energy data and, in particular, to methods for estimating energy savings of an HVAC system.

BACKGROUND

As is well-known, thermostats control heating, ventilation, and air conditioning ("HVAC") systems in buildings. A non-programmable thermostat allows a user, such as an occupant or building manager, to set one setpoint temperature for the heating season and one setpoint temperature for the cooling season to control the HVAC system. When the measured indoor temperature is below or above these setpoint temperatures, the HVAC system is activated. A programmable thermostat allows a user to program setpoint temperatures for different times of the day. For example, in the heating season, many users still set the thermostat to a lower set-back temperature at night. This temperature set-back reduces the amount of time that the HVAC system is activated in order to maintain the lower temperature and thus saves energy and money. However, the energy savings from such time-based programmed setpoint temperatures as compared to the comfort temperature that is set during the day is unknown to a user.

The Energy Star programmable thermostat specification has been in effect since April of 1995. The Energy Star specification states that a programmable thermostat is "a device that enables the user to set one or more time periods each day when a comfort setpoint temperature is maintained and one or more time periods each day when an energy-saving setpoint temperature is maintained." The current specification defines comfort setpoint temperature as "the temperature setting in degrees Fahrenheit or degrees Celsius for the time period during which the building is expected to be occupied, e.g., the early morning and evening hours. The specification defines energy-saving setpoint temperature as "the setpoint temperature for the energy-saving periods usually specified for both the heating and cooling seasons. In the energy-saving mode, the thermostat setpoint may vary from the comfort setpoint temperature to the set-back temperature or the set-up temperature depending on the season. The set-back temperature is the setpoint temperature used during the heating season, normally at night or during unoccupied times of the day. This is a lower setpoint temperature than the comfort setpoint temperature. Similarly, the set-up temperature is a setpoint temperature used during the cooling season, normally at night or during unoccupied times of the day. This is a higher setpoint temperature than the comfort setpoint temperature. This specification has been confusing to users as to how to achieve energy savings from programmable thermostats. The EPA is considering issuing a new Energy Star specification in 2010. Even if the new specification is not finalized, the old Energy Star specification will be suspended due to the confusion to users.

Presently, users that invest in programmable thermostats to save energy and money do not have any ready means to determine how much energy and money is being truly saved. The programmable thermostats therefore are arbitrarily set at different temperatures, which may or may not save the user money and energy. Therefore, the present known programmable thermostats do not provide energy savings feedback to allow a user to adjust temperature setpoints and times based on how the building environment responds to changes in the internal and external environments.

BRIEF SUMMARY

According to at least some aspects of the present disclosure a method of determining energy savings from an HVAC system in a building operating in an energy saving mode is disclosed. The HVAC system is run to maintain a comfort mode temperature during a learning period. The energy consumed by the HVAC system at multiple outside ambient conditions during the learning period is determined. A correlation between a specific ambient condition and energy consumed by the HVAC system is determined. The HVAC system is run to maintain an energy saving setpoint temperature. The energy consumed by the HVAC system at an ambient condition while maintaining the energy saving setpoint temperature is determined. The energy savings is calculated as a function of the difference between the energy that would have been consumed by the HVAC system at the ambient condition based on the determined correlation and the energy consumed by the HVAC system while maintaining the energy saving setpoint temperature at the ambient condition.

Another example disclosed is an energy savings monitoring system having an HVAC system. A thermostat is coupled to the HVAC system to control the HVAC system. The thermostat includes a display and a controller. The controller is operative to run the HVAC system to maintain a comfort mode temperature during a learning period. The controller determines the energy consumed by the HVAC system at multiple outside ambient conditions during the learning period. The controller determines a correlation between a specific ambient condition and energy consumed by the HVAC system. The controller runs the HVAC system to maintain an energy saving setpoint temperature. The controller determines the energy consumed by the HVAC system at an ambient condition while maintaining the energy saving setpoint temperature. The controller calculates the energy savings as a function of the difference between the energy that would have been consumed by the HVAC system at the ambient condition based on the determined correlation and the energy consumed by the HVAC system while maintaining the energy saving setpoint temperature at the ambient condition. The display is operative to display the calculated energy savings.

Additional aspects will be apparent to those of ordinary skill in the art in view of the detailed description of various embodiments, which is made with reference to the drawings, a brief description of which is provided below.

BRIEF DESCRIPTION OF THE DRAWINGS

The foregoing and other advantages of the invention will become apparent upon reading the following detailed description and upon reference to the drawings.

Figure 1:
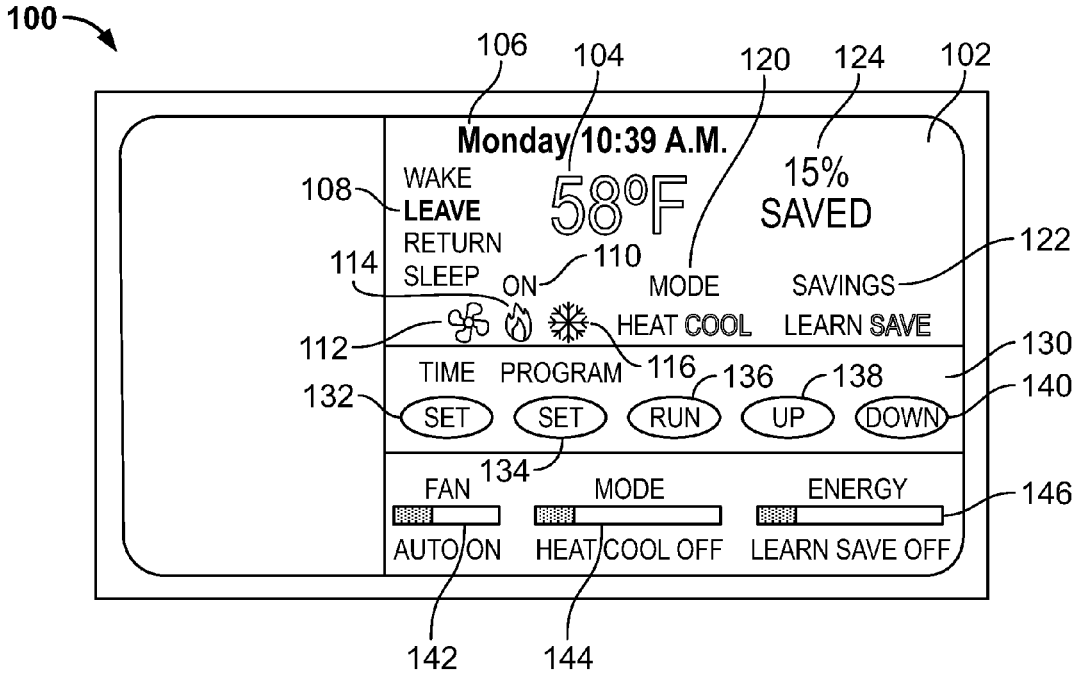
FIG. 1 is a front view of a programmable thermostat for determining and displaying energy savings according to some aspects of the implementations.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

Referring to FIG. 1, a programmable thermostat 100 is shown with a coverplate (not shown) removed. The thermostat 100 includes a display 102 that shows the current operation and status of the HVAC system. The display 102 shows the temperature 104, the date and time 106, and a status field 108. The temperature 104 is the actual room or indoor temperature measured by the thermostat 100. In this example, the temperature is expressed in Fahrenheit but other units of measurement such as Celsius can be used. The status field 108 includes different setpoints that may be programmed such as a Wake setpoint, a Leave setpoint, a Return setpoint, and a Sleep setpoint. The display 102 also includes an "on" indicator 110 with an appropriate set of icons such as a fan icon 112, a heat icon 114, and a cooling icon 116 that indicate the mode of the HVAC system that is currently activated. In this example, the heat icon 114 is highlighted indicating that the heating system of the HVAC system is on providing heat. The cooling icon 116 indicates that the cooling system of the HVAC system is on providing cooling while the fan icon 112 indicates that the fan of the HVAC system is on. A mode field 120 indicates whether the HVAC system is in heating mode or cooling mode. A savings method field 122 indicates the mode of the savings method employed. As will be explained, an option is a learn mode in which the thermostat determines a base amount of energy consumption and another option is a save or savings option, which calculates energy savings based on the current energy savings setpoint temperature. Finally, a savings percentage 124 shows the percentage of energy saved by running the HVAC system to maintain the current setpoint temperature.

The thermostat 100 also includes a control panel 130 that includes programming keys such as a set time key 132, a set program key 134, a run key 136, an up key 138, and a down key 140 that allow a user to change the setpoint temperatures and program the times that the setpoint temperatures are maintained by the HVAC system controlled by the thermostat 100. The control panel 130 also includes a fan switch 142 to activate the fan of the HVAC system, a mode switch 144 that allows activation of the heating and cooling functions of the HVAC system and an energy savings switch 146. The energy savings switch 146 has a learn position, a save position, and an off position for the process of implementing the energy savings display feature as will be explained below.

In this example, the energy savings percentage 124 on the display 102 can be expressed as a percentage of the energy saved by placing the thermostat 100 at a set-back (in the case of heating) or set-up (in the case of cooling) setpoint temperatures versus a comfort setpoint temperature for normal operation of the HVAC system. Alternatively, other energy savings metrics like currency saved or carbon footprint reduction can be used to show the energy savings. These metrics can be derived from the energy measurements by the thermostat 100. Another device such as an off-site computer can be used to calculate the energy savings as will be explained.

Figure 2:
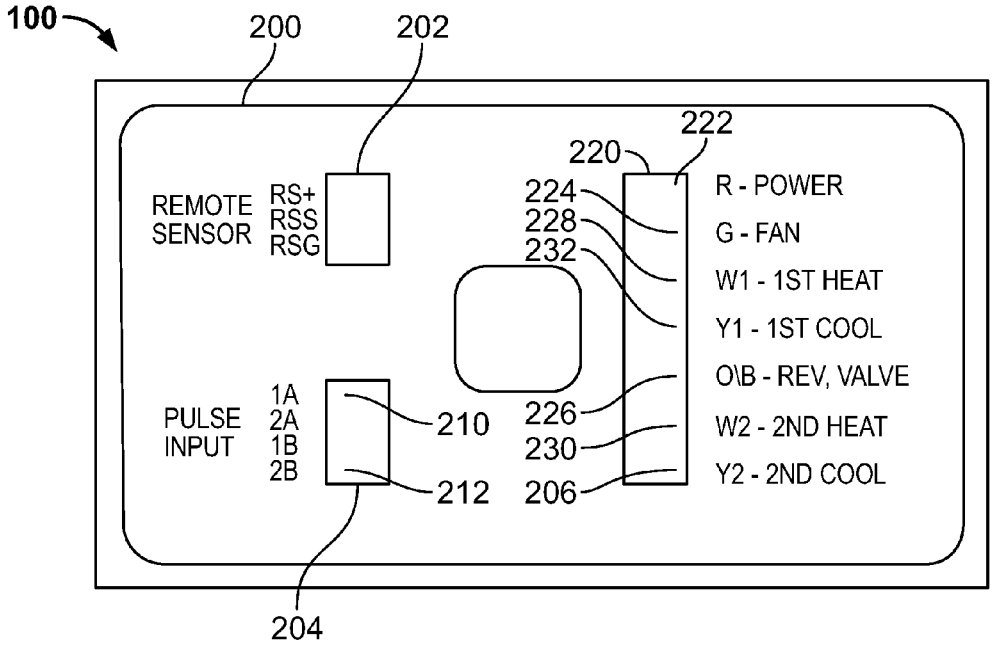
FIG. 2 is a view of the back plate of the programmable thermostat in FIG. 1.

FIG. 2 is a view of the back plate 200 of the thermostat 100. The back plate 200 includes a remote sensor input panel 202, a pulse input panel 204, and an HVAC control output panel 206. The remote sensor input panel 202 receives input signals from a remote sensor or sensors (not shown) which can measure various factors that are used to determine an ambient condition. In this example, one or more of the remote sensors are used to determine outside ambient conditions, which may be used to determine energy savings. Outside ambient conditions include conditions of an outdoor environment or an environment exterior to the room in which the thermostat 100 is installed or an environment that is indicative of outdoors. The pulse input panel 204 in this example has two sets of pulse inputs 210 and 212. The pulse inputs 210 and 212 can be connected to different pulse inputs from the remote sensor or the HVAC system. The HVAC control output panel 206 includes a power output 220, a fan output 222, two heating system control outputs 224 and 226, two cooling system control outputs 228 and 230, and a reversing valve output 232. The outputs 220, 222, 224, 226, 228, 230, and 232 are coupled via wires to the HVAC system. The inputs can be used by the thermostat 100 to activate various components on the HVAC system. In this example, the HVAC system can have two cooling and heating stage units that are individual controlled by the heat control outputs 224 and 226 and the cooling system control outputs 228 and 230 respectively. The reversing value output 232 can be used to control an HVAC system that has a heat pump to alternate from heating and cooling modes. As is well known, in most heat pump systems the basic operation of heating and cooling is accomplished in the same manner. However, below a certain temperature, the outside air does not provide sufficient heat, so a backup heating element that can be either gas or electric is employed. In the case where the HVAC system includes a heat pump, the energy from a compressor and a fan blower are required for both heating and cooling.

Figure 3:
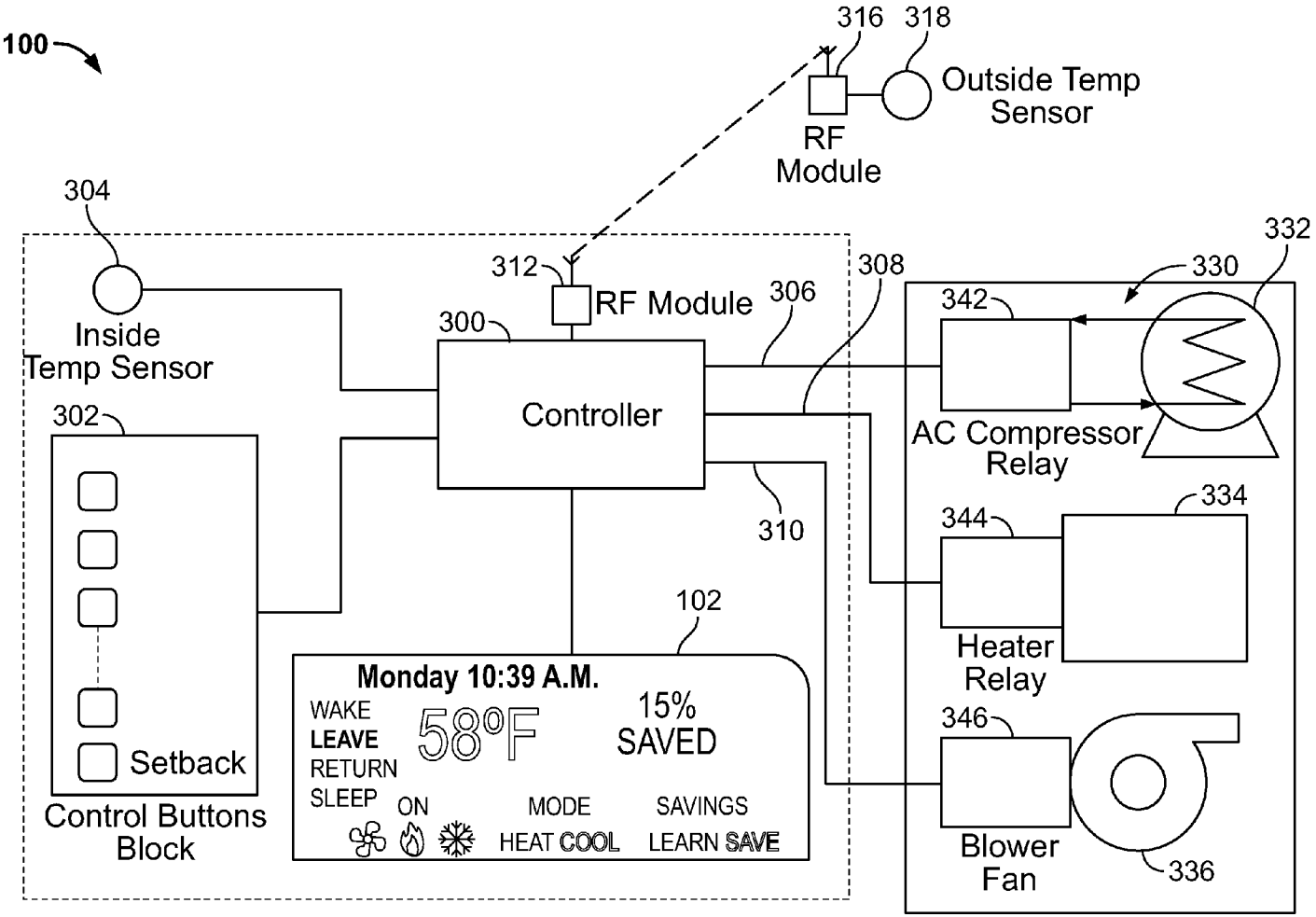
FIG. 3 is a block diagram of the components of the programmable thermostat in FIG. 1.

FIG. 3 is a block diagram of the internal components of the thermostat 100. The thermostat 100 includes a controller 300, a programming control interface 302, an inside temperature sensor 304, a compressor relay output 306, a heater relay output 308, and a blower fan relay output 310. In this example, the thermostat 100 includes an RF module 312 that wirelessly receives data communicated from a remote RF module 316 that is coupled to an outside temperature sensor 318 to determine ambient conditions. Other sensors such as a solar sensor or a humidity sensor can also be coupled to the remote RF module 316 to measure data to determine the ambient conditions. It is to be understood that the outside temperature sensor 318 can be directly coupled to the thermostat 100 rather than sending data via a wireless interface. The controller 300 is also coupled to a storage device 320 that stores correlations found during the learning period, programs to control the HVAC system and programming determined from the control panel 130.

As shown in FIG. 3, the controller 300 controls what is displayed on the display 102. The controller 300 receives programming inputs from the control panel 130 in FIG. 1 via the programming control interface 302. The controller 300 receives temperature data from the indoor temperature sensor 304 representing the temperature inside the building. The various components of the HVAC system 330 may include sensors that are coupled to the pulse inputs 210 and 212 in FIG. 2. Such sensors send pulse inputs that reflect energy consumed by various components of an HVAC system 330. Of course other interfaces may be included in the thermostat 100 to receive additional data from the operation of the HVAC system 330.

In this example, the HVAC system 330 can include a compressor 332, a gas furnace 334, and a blower fan 336. Of course, other heating systems such as an electric furnace or a heat pump may be used instead of the gas furnace 334. The compressor 332 is coupled to a compressor relay 342, which is in turn coupled to the compressor output 306 that allows the thermostat 100 to activate the compressor 332. The furnace 334 is coupled to a heater relay 342, which is in turn coupled to the heater output 308 that allows the thermostat 100 to activate the furnace 334. The fan blower 336 is coupled to a fan blower relay 346, which is in turn coupled to the fan blower output 310 that allows the thermostat 100 to activate the fan blower 336. The HVAC system 300 has a cooling mode that requires electrical energy to operate the compressor 332 to produce cool air and the fan blower 336 to circulate the cool air. The energy consumed in the cooling mode is determined by data from a sensor on the compressor input 332 and a sensor on the fan blower 336. In this example, the HVAC system 300 has a heating mode that requires gas to operate the furnace 334 to produce hot air and electrical power to operate the fan blower 336 to circulate the hot air. The energy consumed in the heating mode includes the gas energy determined by data from the furnace 334 and electrical energy consumed by the fan blower 336 as determined from data from a sensor on the fan blower 336. Alternatively, if the furnace is an electrical furnace, the energy consumed in the heating mode includes electrical energy from the furnace and electrical energy consumed by the fan blower 336. If the furnace is a heat pump, the energy may include energy from the compressor 332, the fan blower 336 and in some cases of colder temperature, the energy from a back up heating system.

The thermostat 100 allows the display of energy savings based on data inputs on the display 102 in FIG. 1. The energy savings are based on a learn mode where the thermostat 100 learns the correlations for energy usage from different ambient conditions to estimate and display energy savings from operating the HVAC system 330 at an energy saving setpoint temperature at any particular ambient condition in comparison to operating the HVAC system at a comfort temperature.

In this example, there are three different methods of learning the correlation between ambient conditions and energy use by the HVAC system 330 to determine energy savings. A first method requires instruments on the HVAC system 330 to monitor electrical power and/or gas consumption and a sensor such as the outdoor temperature sensor 318 to measure outdoor ambient conditions. A second method estimates energy savings by monitoring the on and off times of the HVAC system 330. The second method requires a sensor such as the outdoor temperature sensor 318 to measure outdoor ambient condition. Since the on-time of the HAVC system 330 will trend the power and gas consumption of the HVAC system 330, additional instruments on the HVAC system 330 are not required. A third method estimates energy savings by reviewing the heat loss of the building and the on and off times of the HVAC system 300, therefore not requiring any additional instruments.

Figure 4:
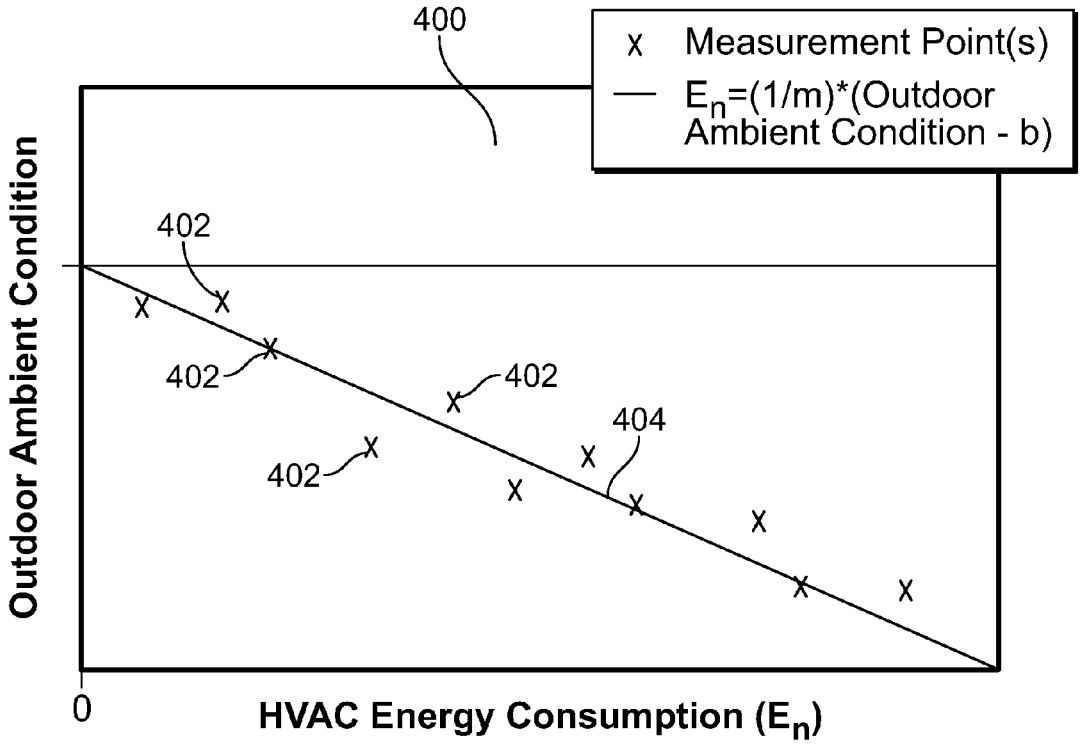
FIG. 4 is a graph showing the curve derived from the learning period of the programmable thermostat according to one process for determining energy consumption during a comfort temperature setpoint.

The first method estimates energy savings by measuring the outdoor ambient conditions, electrical power and/or gas consumption during comfort setpoint operation and during set-back or set-up operation and therefore uses a variety of the inputs for the thermostat 100 shown in FIGS. 2-3. The electrical power can be measured on the branch breakers of the load center or on the individual HVAC equipment such as the blower fan relay 346 in FIG. 3. The gas consumption can be measured on the feeder line to the gas furnace 334 via the heater relay 344 to produce electrical impulses reflecting gas consumption. The outdoor ambient conditions can be measured by the outdoor temperature sensor 318 mounted exterior to the building, such as on the sunniest exterior wall of the building, or mounted inside the building in an environment that is indicative of the temperature of the outdoor environment. Other sensors can measure humidity and solar exposure that contribute to the outdoor ambient conditions. The measurement devices communicate their read data via wired or wireless connection to the thermostat 100. After installation of the thermostat 100, a learning mode is initiated where the thermostat 100 is set to run at a comfort setpoint temperature. During the learning period, the energy consumption of the HVAC system 300 and the outdoor ambient conditions are recorded at fixed time intervals. The outdoor ambient conditions can be determined via temperature, solar radiation, humidity, and other data factors. FIG. 4 is graph 400 including measurement points 402 of the energy consumed by the HVAC system 300 operating to maintain the comfort setpoint temperature. In the graph 400, the vertical axis is a scale of the ambient conditions expressed in terms of temperature while the horizontal axis is the energy consumption of the HVAC system 300. The slope of a curve 406 is derived from the measurement points 402 and represents the correlation between the energy consumption ($E_n$) of the HVAC system 330 and the ambient conditions.

At the end of the learning period, an equation is developed that provides the energy consumed by the HVAC system 300 for any given outdoor ambient condition (such as temperature). As shown in FIG. 4, the equation is a linear curve or slope 406 or some other form that adequately fits the measured data points 402. In this example, the learning period can be several days or the time necessary for a 20% variation in ambient conditions. The user can switch the thermostat into an energy savings mode after the learning period ends.

In this example, the energy savings during set-back operation can be estimated by first estimating the HVAC energy consumption for the comfort setpoint temperature using the equation developed in the learning mode and the measured outside ambient conditions during set-back operation. This equation is:

$$E_n=(1/m)*(\text{Outdoor Ambient Condition}-b)$$

In this equation, m is the slope that is calculated during the learning period based on the measured data points 402, the outdoor ambient condition is based on data such as temperature measured from the outdoor sensor 318 and b is a constant determined from the learning period. The HVAC energy consumption ($E_s$) is measured for the set-back (set-up) setpoint temperature and the savings are estimated according to the following equation:

$$\text{Percentage Savings}=[(E_n-E_s)/E_n]*100$$

The percentage is therefore the difference between the energy consumption for the comfort setpoint temperature and the energy consumption for the set-back setpoint temperature used during the heating mode of the HVAC system 330. A different curve can be derived in the same manner for the set-up temperature used during the cooling mode of the HVAC system 330.

The second method of determining energy consumption savings estimates energy savings by monitoring the on and off times of the HVAC system 330. The on time of the HVAC system 330 will reflect the power and gas consumption of the HVAC system 330 during the heating and cooling modes. The on times of the HVAC system 330 are controlled by the thermostat 100, which stores the times that the HVAC system 330 are activated while maintaining the setpoint temperature in order to determine the on-time intervals and the intervals between the on-times. This method does not require any additional instruments on the HVAC system 330 but requires an outside sensor such as the sensor 318 to measure data such as temperature to determine the outdoor ambient conditions. As with the example above, the outside sensor 318 is preferably mounted on the sunniest wall of the building.

After installation of the thermostat 100, a learning mode is initiated. The thermostat 100 is run at the comfort setpoint temperature during the learning period. During the learning period, the on and off times of the HVAC system 330 and the outdoor ambient conditions derived from factors such as temperature are recorded at fixed intervals as shown in a graph 500 in FIG. 5. The graph 500 is a plot of the recorded measured data points 502 for the second method. The graph 500 has a vertical axis representing the outdoor ambient condition while a horizontal axis represents the fraction of on time ($F_n$) of the HVAC system 330. A curve 504 is interpolated based on the measured data points 502. The curve 504 is mapped from the measurement points 502 and the slope variable, m, and the constant value, b, are determined and stored for future use. In this example, the learning period may be several days or the time necessary for a 20% variation in ambient conditions.

Figure 5:
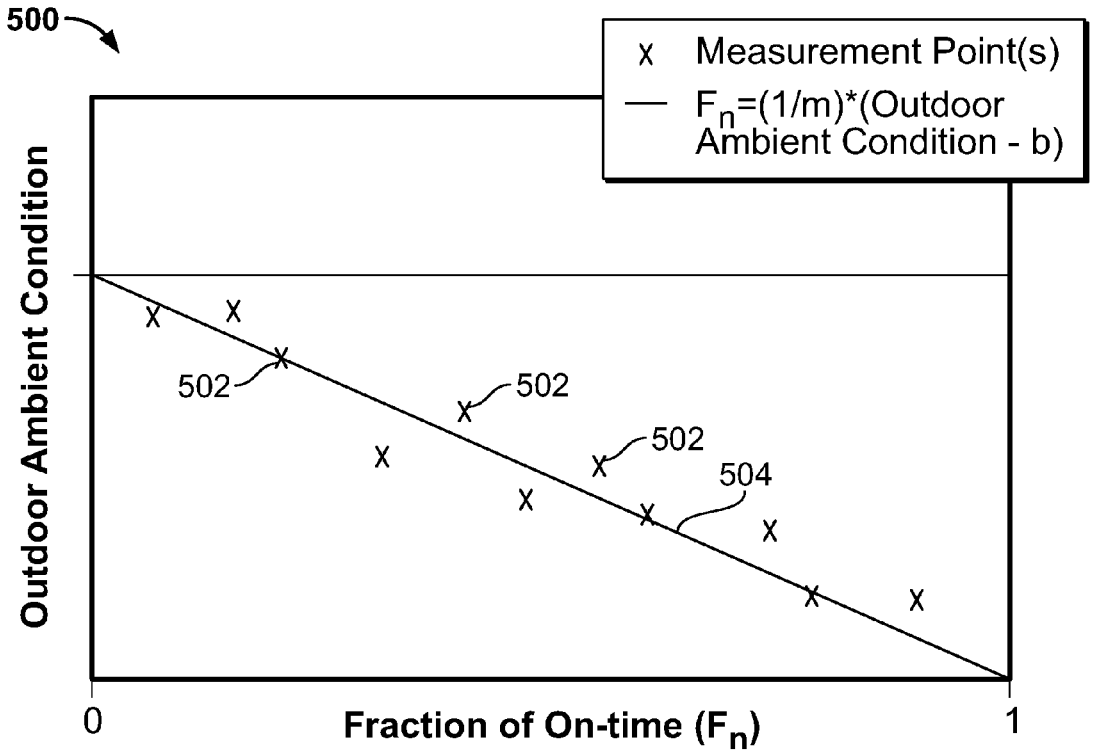
FIG. 5 is a graph showing the curve derived from the learning period of the programmable thermostat according to another process for determining energy consumption during a comfort setpoint temperature.

At the end of the learning period, an equation is developed that determines the energy consumed by the HVAC system 300 for any given outdoor ambient condition. As shown in FIG. 5, the equation is determined from the linear curve or slope 504 or some other form that adequately fits the measured data points 502. The user may switch the thermostat 100 into an energy savings mode after the learning period ends.

Figure 6:
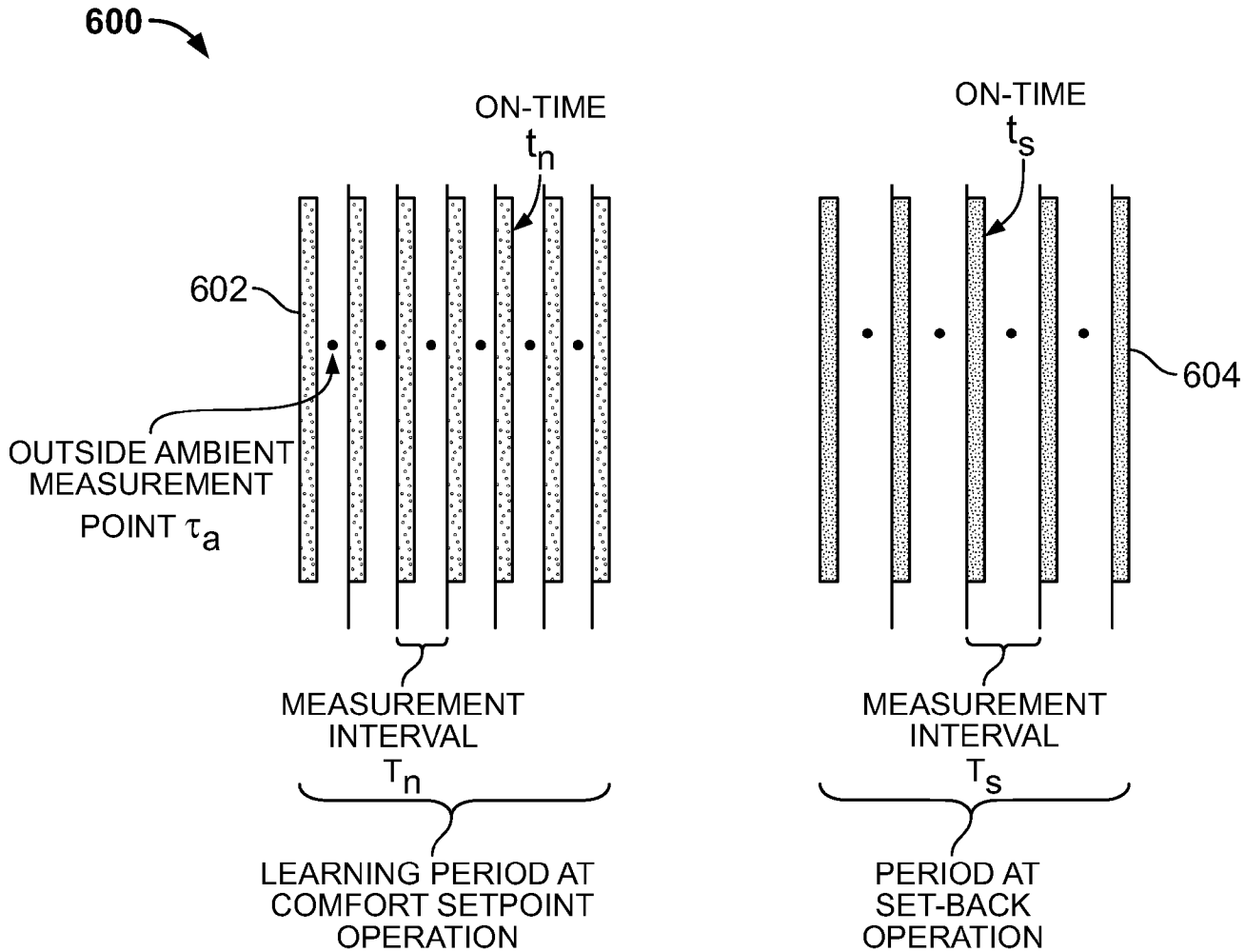
FIG. 6 is a graph comparing the on times of an HVAC system operating with an energy consumption setpoint temperature and operating at a comfort setpoint temperature.

During the set-back or the set-up operation at the respective setpoint temperatures, the outside ambient condition derived from the temperature and the on and off times of the HVAC system 330 will be recorded at fixed intervals. FIG. 6 is a timing diagram 600 that shows an interval of on times 602 during the learning period at the comfort setpoint temperature and an interval of on times 604 during the operation of the HVAC system 330 at the energy saving setpoint temperature. FIG. 6 shows the longer intervals between on times at set-back operation of the thermostat 100 as compared to the intervals between on times at comfort setpoint temperature therefore resulting in energy savings from the more infrequent use of the HVAC system 330.

The energy savings during set-back operation may be estimated by first estimating the fraction of on-times for the HVAC system 300 maintaining the comfort setpoint temperature using the equation determined during learning mode and outside ambient conditions during the set-back operation. This fraction may be determined using the following equation:

$$F_n=(1/m)*(\text{Outdoor Ambient Condition}-b)$$

In this equation, m is the slope derived from the learning mode, the outdoor ambient condition is determined from the temperature measured from the outdoor sensor 318 and b is a constant determined from the learning period. The energy savings are estimated according to the following equation:

$$\text{Percentage Savings}=[(F_nT_s-t_s)/(F_nT_s)]*100$$

As shown in FIG. 6, $t_n$ is the on time of the HVAC system 330, while $T_n$ is the measurement interval between the on-times ($t_n$) during the comfort setpoint temperature operation. Correspondingly, $t_s$ is the on-time of the HVAC system 300 to maintain the set-back setpoint temperature during the period of set-back operation, while $T_s$ is the measurement interval between the on-times ($t_s$) during the set-back operation.

The percentage is therefore the difference between the energy consumption for the comfort setpoint temperature and the energy consumption for the set-back setpoint temperature as reflected in the percentage of time the HVAC system 330 is on at a certain ambient condition.

The third method estimates energy savings by examining the energy loss to the building and the on and off times of the HVAC system 330. This method does not require any additional instruments on the HVAC system 330. Over a period of time, the energy lost from the building will be compensated by the energy gained from the HVAC system 330 in order to maintain a fixed indoor ambient temperature. The energy gained from the HVAC system 330 is proportional to the energy used by the HVAC system 330. For example, for 1 kWh of energy used in an electric heat pump, 3 kWh of energy from the outdoor ambient environment is obtained in the building for heating. The energy savings can be written as:

$$\text{Savings}=\Delta E/E=(E_n-E_s)/E_n=[(P_n-P_s)*t]/(P_n-*t)=(P_n-P_s)/(P_n).$$

In this equation, $E_n$ is the energy consumed by the HVAC system 330 at normal operation (comfort setpoint temperature), and $E_s$ is the energy consumed by the HVAC system 330 at set-back operation. Correspondingly, $P_n$ is the power consumed by the HVAC system 330 at normal operation, and $P_s$ is the power consumed by the HVAC system at set-back operation. For a given indoor temperature and outdoor ambient condition, the equivalent power of the HVAC system 330, $P_n$ may be written as:

$$P_n=P_0*(t_n/T_n)=P_0*F_n.$$

In this equation, $F_n$ is the ratio of on-time during measurement time period or the fraction of on-time of the HVAC system 330 at normal operation to maintain the comfort setpoint temperature as shown in FIG. 6. $P_0$ is the maximum power of the HVAC system 330. If the set-back point is lowered, then the equivalent power of the HVAC system, $P_s$ at the set-back point will also be lowered:

$$P_s=P_0*(t_s/T_s)=P_0*F_s.$$

In this equation, Fs is the ratio of on-time to measurement time period or the fraction of on-time during set-back operation as shown in FIG. 6. FIG. 6 shows that during operation at a comfort setpoint temperatures, the intervals between on-times 602 is relatively less while the intervals between on-times during the set-back operation 604 are relatively greater, resulting in energy savings. As explained above, the amount of energy savings is proportional to the difference in the calculated energy for the HVAC system 330 based on the on-time intervals to maintain the energy saving set-back setpoint temperature to the calculated energy that the HVAC system 330 based on the on-time intervals assuming operation to maintain the comfort setpoint temperature.

Figure 7:
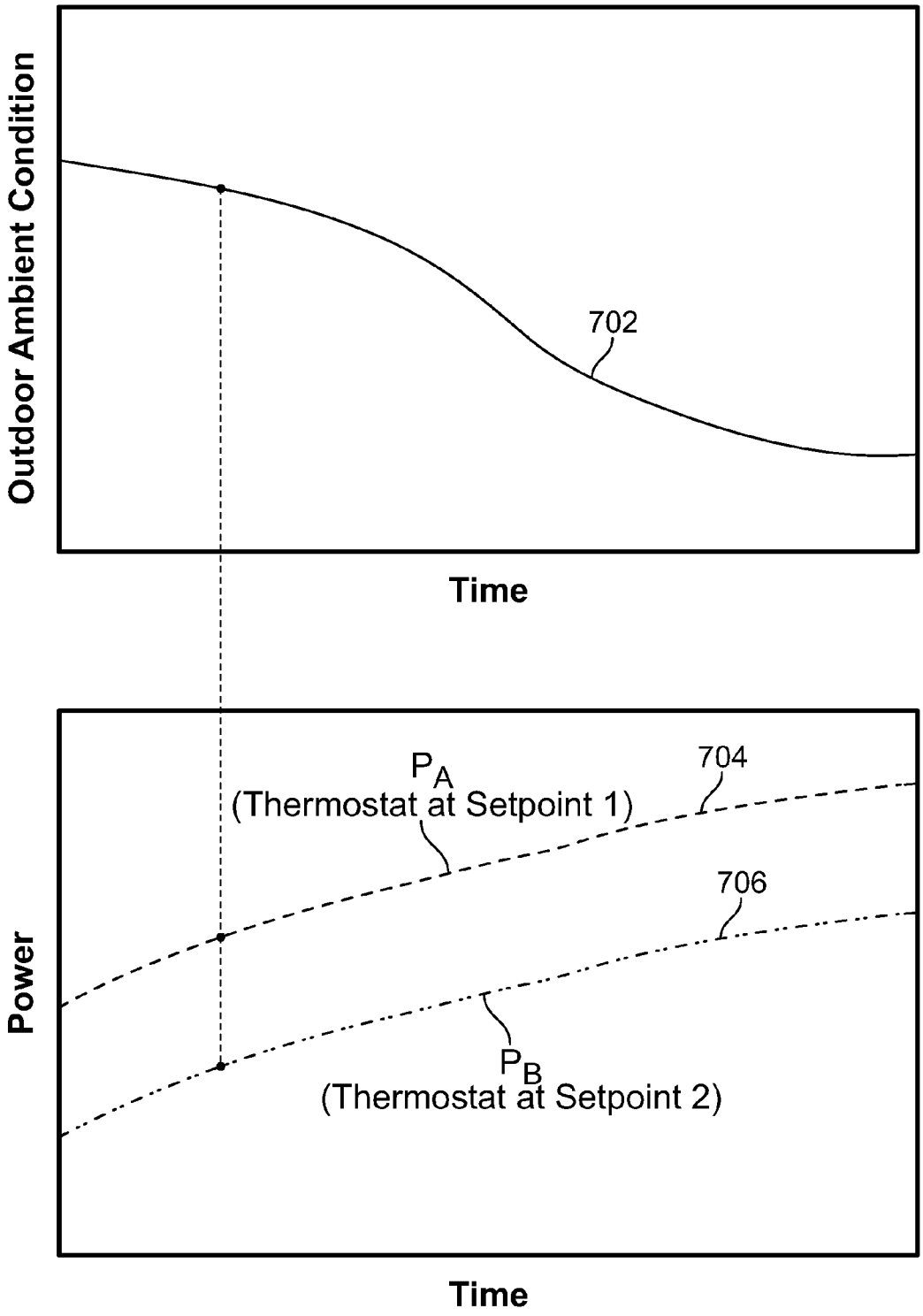
FIG. 7 is a graph comparing the ambient condition with different setpoint temperatures used for another process for determining energy consumption during a comfort setpoint temperature.

Further, changes in outdoor ambient conditions change the equivalent power at the two setpoint temperatures as shown in FIG. 7, which is a plot of the ambient conditions 702 in comparison to the power plots of the HVAC system 330 at the two setpoint temperatures 704 and 706. The energy therefore leaves the building at a rate proportional to the indoor and outdoor temperature difference. This heat loss rate, Q, may be expressed as:

$$Q=\kappa(T_{indoor}-T_{outdoor})$$

In this equation, the variable, κ, is a type of heat loss coefficient that depends on the construction of the building. Changing the indoor setpoint temperature will change the power supplied and the heat lost. The change in power supplied by the HVAC system 330 can be written as:

$$\Delta P=P_n-P_s=P_0*F_n-P_0*F_s$$

In this equation, the change in power ΔP is derived from the maximum power of the HVAC system 330 multiplied by the ratio of the on-time, $F_n$, during the comfort setpoint temperature operation and the maximum power of the HVAC system 330 multiplied by the ratio of the on-time, $F_s$, during the energy saving setpoint temperature. The change of heat leaving the building may be written as:

$$\Delta Q=Q_n-Q_s=\kappa(T_{indoor\ n}-T_{outdoor\ s})$$

Equating the change in power and the change in heat loss provides an equation for saved power to consumed power for a lower setpoint temperature at any time, $t_x$, during the operation of the thermostat 100 at a lower setpoint temperature.

$$\frac{\Delta P}{P(t_x)}=\frac{\kappa*(T_{indoor_n}-T_{indoor_s})}{F(t_x)*P_0}=\alpha\frac{\Delta T}{F(t_x)}$$

The learning mode is used to determine the coefficient, cc. In this mode, the thermostat 100 examines the transition period from the HVAC system 330 maintaining one setpoint temperature to the HVAC system 330 maintaining another setpoint temperature. It is assumed that during the transition the outdoor ambient conditions are fairly constant and if the fraction of on-time just before ($F_a$) and just after ($F_b$) the transition is measured, the α coefficient may be estimated with the following:

$$\alpha=(F_a-F_b)/(T_a-T_b)$$

At the end of the learning period the user can switch the thermostat 100 into an energy savings mode. During the energy savings mode the coefficient, α may be checked and refined with further setpoint temperature changes. To calculate the saved power to consumed power without operating at the setback temperature, the controller 300 determines the following:

$$\%\ \text{Savings}=\frac{\Delta P}{P_{WithOutSetback}}=\frac{\Delta P}{P_{WithSetback}+\Delta P}=\frac{1}{\frac{P_{WithSetback}}{\Delta P}+1}=\frac{1}{\left(1+\frac{P(t_x)}{\Delta P}\right)}*100$$

where $\frac{\Delta P}{P(t_x)}$ is calculated from the previous expression and $P_{withOutSetback}$ is the power of the HVAC system 300 at the comfort setpoint temperature and $P_{withSetback}$ is the power of the HVAC system 300 at the setback setpoint temperature.

Although an example of the controller 300 is described and illustrated herein in connection with FIG. 3, this component can be implemented on any suitable computer system or computing device. It is to be understood that the example controller 300 in FIG. 3 are for exemplary purposes, as many variations of the specific hardware and software used are possible, as will be appreciated by those skilled in the relevant art(s).

Furthermore, each of the devices can be conveniently implemented using one or more general purpose computer systems, microprocessors, digital signal processors, microcontrollers, application specific integrated circuits (ASIC), programmable logic devices (PLD), field programmable logic devices (FPLD), field programmable gate arrays (FPGA), and the like, programmed according to the teachings as described and illustrated herein, as will be appreciated by those skilled in the computer, software, and networking arts.

In addition, two or more computing systems or devices can be substituted for the controller 300 in FIG. 3. Accordingly, principles and advantages of distributed processing, such as redundancy, replication, and the like, also can be implemented, as desired, to increase the robustness and performance of the controller 300 in FIG. 3. The controller 300 in FIG. 3 can also be implemented on a computer system or systems that extend(s) across any network environment using any suitable interface mechanisms and communications technologies including, for example, telecommunications in any suitable form (e.g., voice, modem, and the like), Public Switched Telephone Network (PSTNs), Packet Data Networks (PDNs), the Internet, intranets, a combination thereof, and the like.

Figure 8:
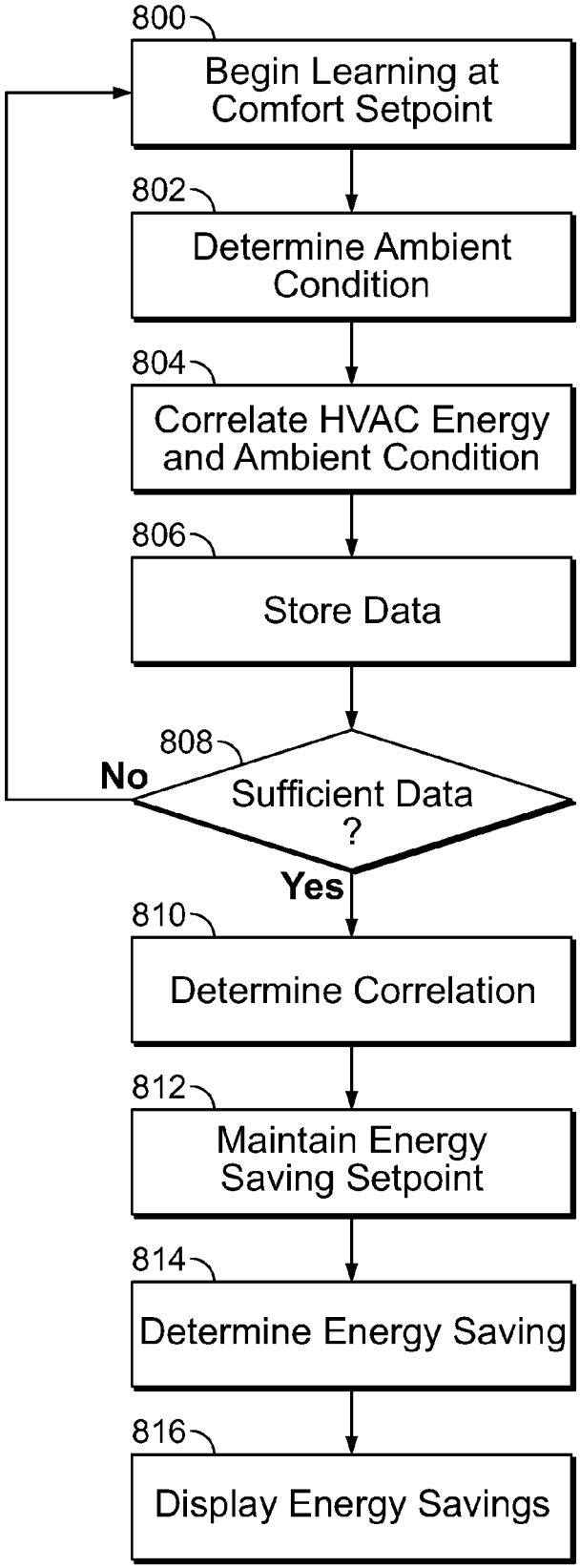
FIG. 8 is a flow chart diagram of the process of determining energy savings using a learning period used by the thermostat in FIG. 1.

The operation of the example process to estimate and display energy savings shown in FIGS. 1-7, which can be run on the controller 300, will now be described with reference to FIGS. 1-3 in conjunction with the flow diagram shown in FIG. 8. The flow diagram in FIG. 8 is representative of example machine-readable instructions for implementing the processes described above to calculate and display energy savings of the operation of HVAC system 330 at an energy savings setpoint temperature in FIG. 3. In this example, the machine readable instructions comprise an algorithm for execution by: (a) a processor, (b) a controller, and/or (c) one or more other suitable processing device(s). The algorithm can be embodied in software stored on tangible media such as, for example, a flash memory, a CD-ROM, a floppy disk, a hard drive, a digital video (versatile) disk (DVD), or other memory devices, but persons of ordinary skill in the art will readily appreciate that the entire algorithm and/or parts thereof could alternatively be executed by a device other than a processor and/or embodied in firmware or dedicated hardware in a well-known manner (e.g., it may be implemented by an application specific integrated circuit (ASIC), a programmable logic device (PLD), a field programmable logic device (FPLD), a field programmable gate array (FPGA), discrete logic, etc.). For example, any or all of the components of the controller 300 in FIG. 3 could be implemented by software, hardware, and/or firmware. Also, some or all of the machine readable instructions represented by the flowchart of FIG. 8 can be implemented manually. Further, although the example algorithm is described with reference to the flowchart illustrated in FIG. 8, persons of ordinary skill in the art will readily appreciate that many other methods of implementing the example machine readable instructions can alternatively be used. For example, the order of execution of the blocks can be changed, and/or some of the blocks described can be changed, eliminated, or combined.

The controller 300 begins the learning period by setting the HVAC system 330 to maintain a comfort setpoint temperature (800). The controller 300 measures the outdoor ambient condition via a sensor or sensors external to the building and applicable energy data for the HVAC system 330 (802). The controller 300 correlates that outdoor ambient condition with the energy of the HVAC system 330 (804). As detailed above, the energy of the HVAC system 330 can be a direct measurement such as gas and electrical power or it can be an estimate based on the time intervals between each time the HVAC system 330 is activated to maintain the comfort setpoint temperature. The exact data gathered by the controller 300 depends on which of the three above described methods the controller 300 is using. The measured data is stored in the storage device 320 in FIG. 3 by the controller 300 (806). The controller 300 determines whether there are sufficient data points for the learning period (808). The number of data points can be collected during a set period of time or with sufficient variation of the outdoor ambient conditions. If there are insufficient data points, the controller 300 loops back and measures another outdoor ambient condition and HVAC system data (802).

If there are sufficient data points, the controller 300 determines the correlation between the ambient conditions and the energy to maintain the comfort setpoint temperature such as by determining the slope of a curve as in FIGS. 4 and 5 (810). The thermostat 100 is programmed with an energy saving setpoint temperature and the thermostat 100 controls the HVAC system 330 to maintain the building at the energy saving setpoint temperature (812). The controller 300 determines the energy savings based on the difference between the energy that would have been consumed by the HVAC system 330 at the ambient condition based on the determined correlation from the learning mode and the energy consumed by the HVAC system 330 while maintaining the energy saving setpoint temperature at the ambient condition (814). The exact determination made by the controller 300 depends on which of the three above described methods the controller 300 is using. The energy saving data is displayed on the display 102 (816).

While the present invention has been described with reference to one or more particular embodiments, those skilled in the art will recognize that many changes can be made thereto without departing from the spirit and scope of the present invention. Each of these embodiments and obvious variations thereof is contemplated as falling within the spirit and scope of the claimed invention, which is set forth in the following claims.

What is claimed is:

1. A method of determining energy savings from an HVAC system in a building operating in an energy saving mode, the method comprising:

running the HVAC system to maintain a comfort mode temperature during a learning period;

determining the energy consumed by the HVAC system at multiple outside ambient conditions during the learning period;

after the conclusion of the learning period, determining a correlation between a specific ambient condition and energy consumed by the HVAC system at the specific ambient condition, the correlation determined based on the multiple outside ambient conditions and corresponding energy consumed by the HVAC system during those multiple outside ambient conditions, wherein the correlation is determined as a function of outdoor ambient conditions and power consumed by the HVAC system to maintain the comfort mode setpoint temperature; and wherein the energy consumed by the HVAC system while maintaining the energy saving setpoint temperature is determined by the power consumed by the HVAC system while maintaining the energy saving setpoint temperature;

running the HVAC system to maintain an energy saving setpoint temperature after the conclusion of the learning period;

determining the energy consumed by the HVAC system at an ambient condition while maintaining the energy saving setpoint temperature; and calculating the energy savings as a function of the difference between the energy that would have been consumed by the HVAC system at the ambient condition based on the determined correlation and the energy consumed by the HVAC system while maintaining the energy saving setpoint temperature at the ambient condition.

2. The method of claim 1, wherein the energy savings is displayed on a display.

3. The method of claim 2, wherein the display is on a thermostat.

4. The method of claim 1 wherein the energy saving setpoint temperature is controlled by a thermostat.

5. The method of claim 1, wherein the energy savings is expressed as a percentage of energy saved between the energy at the comfort mode setpoint temperature and the energy saving setpoint temperature.

6. The method of claim 1, wherein the energy savings is expressed as currency or carbon footprint reduction.

7. The method of claim 1, wherein the energy savings setpoint temperature is either a set-back temperature when the HVAC system is in cooling mode or a set-up temperature when the HVAC system is in heating mode.

8. The method of claim 1, wherein the ambient condition is a function of outside temperature, humidity, solar coverage, or any combination thereof.

9. The method of claim 8, wherein the ambient condition is determined via a temperature sensor in communication with a thermostat.

10. A method of determining energy savings from an HVAC system in a building operating in an energy saving mode, the method comprising:

running the HVAC system to maintain a comfort mode temperature during a learning period;

determining the energy consumed by the HVAC system at multiple outside ambient conditions during the learning period;

after the conclusion of the learning period, determining a correlation between a specific ambient condition and energy consumed by the HVAC system at the specific ambient condition, the correlation determined based on the multiple outside ambient conditions and corresponding energy consumed by the HVAC system during those multiple outside ambient conditions, wherein the correlation is determined as a function of outdoor ambient conditions and the on and off times of the HVAC system while maintaining the comfort mode setpoint temperature; and wherein the energy consumed by the HVAC system while maintaining the energy saving setpoint temperature is determined by the on and off times of the HVAC system while maintaining the energy saving setpoint temperature;

running the HVAC system to maintain an energy saving setpoint temperature after the conclusion of the learning period;

determining the energy consumed by the HVAC system at an ambient condition while maintaining the energy saving setpoint temperature; and calculating the energy savings as a function of the difference between the energy that would have been consumed by the HVAC system at the ambient condition based on the determined correlation and the energy consumed by the HVAC system while maintaining the energy saving setpoint temperature at the ambient condition.

11. A method of determining energy savings from an HVAC system in a building operating in an energy saving mode, the method comprising:

running the HVAC system to maintain a comfort mode temperature during a learning period;

determining the energy consumed by the HVAC system at multiple outside ambient conditions during the learning period;

after the conclusion of the learning period, determining a correlation between a specific ambient condition and energy consumed by the HVAC system at the specific ambient condition, the correlation determined based on the multiple outside ambient conditions and corresponding energy consumed by the HVAC system during those multiple outside ambient conditions, wherein the correlation is determined by the difference in on and off times of the HVAC system while maintaining the comfort mode setpoint temperature and maintaining a second setpoint temperature; and wherein the energy consumed by the HVAC system while maintaining the energy saving setpoint temperature is determined by the energy saving setpoint temperature;

running the HVAC system to maintain an energy saving setpoint temperature after the conclusion of the learning period;

determining the energy consumed by the HVAC system at an ambient condition while maintaining the energy saving setpoint temperature; and calculating the energy savings as a function of the difference between the energy that would have been consumed by the HVAC system at the ambient condition based on the determined correlation and the energy consumed by the HVAC system while maintaining the energy saving setpoint temperature at the ambient condition.

12. An energy savings monitoring system, comprising:

an HVAC system;

a thermostat coupled to the HVAC system to control the HVAC system, the thermostat including a display and a controller operative to:

run the HVAC system to maintain a comfort mode temperature during a learning period;

determine the energy consumed by the HVAC system at multiple outside ambient conditions during the learning period;

after the conclusion of the learning period, determine a correlation between a specific ambient condition and energy consumed by the HVAC system at the specific ambient condition, the correlation determined based on the multiple outside ambient conditions and corresponding energy consumed by the HVAC system during those multiple outside ambient conditions, wherein the correlation is determined as a function of outdoor ambient conditions and power consumed by the HVAC system to maintain the comfort mode setpoint temperature; and wherein the energy consumed by the HVAC system while maintaining the energy saving setpoint temperature is determined by the power consumed by the HVAC system while maintaining the energy saving setpoint temperature;

run the HVAC system to maintain an energy saving setpoint temperature after the conclusion of the learning period;

determine the energy consumed by the HVAC system at an ambient condition while maintaining the energy saving setpoint temperature; and calculate the energy savings as a function of the difference between the energy that would have been consumed by the HVAC system at the ambient condition based on the determined correlation and the energy consumed by the HVAC system while maintaining the energy saving setpoint temperature at the ambient condition, wherein the display is operative to display the calculated energy savings.

13. The energy savings monitoring system of claim 12, wherein the HVAC system includes a gas fed furnace, a compressor and a blower fan.

14. The energy savings monitoring system of claim 12, wherein the HVAC system includes at least one of an electrical furnace or a heat pump.

15. The energy savings monitoring system of claim 12, wherein the energy savings is expressed as a percentage of energy saved between the energy at the comfort mode setpoint temperature and the energy saving setpoint temperature.

16. The energy savings monitoring system of claim 12, wherein the energy savings is expressed as currency or carbon footprint reduction.

17. The energy savings monitoring system of claim 12, wherein the energy savings setpoint temperature is either a set-back temperature when the HVAC system is in cooling mode or a set-up temperature when the HVAC system is in heating mode.

18. The energy savings monitoring system of claim 12, wherein the ambient condition is a function of outside temperature, humidity, solar coverage, or any combination thereof.

19. The energy savings monitoring system of claim 18, wherein the ambient condition is determined via a temperature sensor in communication with the thermostat.

20. An energy savings monitoring system, comprising:

an HVAC system;

a thermostat coupled to the HVAC system to control the HVAC system, the thermostat including a display and a controller operative to:

run the HVAC system to maintain a comfort mode temperature during a learning period;

determine the energy consumed by the HVAC system at multiple outside ambient conditions during the learning period;

after the conclusion of the learning period, determine a correlation between a specific ambient condition and energy consumed by the HVAC system at the specific ambient condition, the correlation determined based on the multiple outside ambient conditions and corresponding energy consumed by the HVAC system during those multiple outside ambient conditions, wherein the correlation is determined as a function of outdoor ambient conditions and the on and off times of the HVAC system while maintaining the comfort mode setpoint temperature; and wherein the energy consumed by the HVAC system while maintaining the energy saving setpoint temperature is determined by the on and off times of the HVAC system while maintaining the energy saving setpoint temperature;

run the HVAC system to maintain an energy saving setpoint temperature after the conclusion of the learning period;

determine the energy consumed by the HVAC system at an ambient condition while maintaining the energy saving setpoint temperature; and calculate the energy savings as a function of the difference between the energy that would have been consumed by the HVAC system at the ambient condition based on the determined correlation and the energy consumed by the HVAC system while maintaining the energy saving setpoint temperature at the ambient condition, wherein the display is operative to display the calculated energy savings.

21. An energy savings monitoring system, comprising:

an HVAC system;

a thermostat coupled to the HVAC system to control the HVAC system, the thermostat including a display and a controller operative to:

run the HVAC system to maintain a comfort mode temperature during a learning period;

determine the energy consumed by the HVAC system at multiple outside ambient conditions during the learning period;

after the conclusion of the learning period, determine a correlation between a specific ambient condition and energy consumed by the HVAC system at the specific ambient condition, the correlation determined based on the multiple outside ambient conditions and corresponding energy consumed by the HVAC system during those multiple outside ambient conditions, wherein the correlation is determined by the difference in on and off times of the HVAC system while maintaining the comfort mode setpoint temperature and maintaining a second setpoint temperature; and wherein the energy consumed by the HVAC system while maintaining the energy saving setpoint temperature is determined by the energy saving setpoint temperature;

run the HVAC system to maintain an energy saving setpoint temperature after the conclusion of the learning period;

determine the energy consumed by the HVAC system at an ambient condition while maintaining the energy saving setpoint temperature; and calculate the energy savings as a function of the difference between the energy that would have been consumed by the HVAC system at the ambient condition based on the determined correlation and the energy consumed by the HVAC system while maintaining the energy saving setpoint temperature at the ambient condition, wherein the display is operative to display the calculated energy savings.

* * * * *